US010571833B2

(12) United States Patent
Uehara

(10) Patent No.: US 10,571,833 B2
(45) Date of Patent: Feb. 25, 2020

(54) IMAGE FORMING APPARATUS THAT PREVENTS IMAGE DEFECTS AND REDUCES FIRST COPY OUTPUT TIME

(71) Applicant: CANON KABUSHIKI KAISHA, Tokyo (JP)

(72) Inventor: Takashi Uehara, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/925,560

(22) Filed: Mar. 19, 2018

(65) Prior Publication Data

US 2018/0275569 A1 Sep. 27, 2018

(30) Foreign Application Priority Data

Mar. 22, 2017 (JP) ..... 2017-056112

(51) Int. Cl.
*G03G 15/02* (2006.01)
*G03G 15/06* (2006.01)
*G03G 15/16* (2006.01)

(52) U.S. Cl.
CPC ..... *G03G 15/1675* (2013.01); *G03G 15/0266* (2013.01); *G03G 15/065* (2013.01)

(58) Field of Classification Search
None
See application file for complete search history.

(56) References Cited

U.S. PATENT DOCUMENTS

| | | | | |
|---|---|---|---|---|
| 8,270,861 | B2 * | 9/2012 | Takahashi | G03G 15/1675 399/48 |
| 9,091,969 | B2 * | 7/2015 | Yoshida | G03G 15/1675 |
| 2014/0186064 | A1 * | 7/2014 | Matsuura | G03G 15/0266 399/50 |
| 2014/0255050 | A1 * | 9/2014 | Yoshida | G03G 15/1675 399/46 |
| 2016/0077456 | A1 * | 3/2016 | Kojima | G03G 15/0266 399/50 |

FOREIGN PATENT DOCUMENTS

| | | |
|---|---|---|
| JP | 2011-180458 A | 9/2011 |
| JP | 2014170156 A | 9/2014 |
| JP | 2015028604 A | 2/2015 |

* cited by examiner

*Primary Examiner* — Victor Verbitsky
(74) *Attorney, Agent, or Firm* — Canon U.S.A., Inc. IP Division

(57) ABSTRACT

A charging bias output portion is controlled so that a direct-current component of a charging bias voltage reaches a target voltage value taking a first set time after output start. A transfer bias output portion is controlled so that output of a transfer bias is started after a first position of an image bearing member reaches a transfer position and before a second position reaches the transfer portion, and a transfer current reaches a target current value taking a second set time. The first position is a position of the image bearing member that passes through a charging portion between a charging member and the image bearing member at a timing when the output of the charging DC is started, and the second position is a position that passes through the charging portion at a timing when the charging DC reaches the target voltage value.

9 Claims, 10 Drawing Sheets

IMAGE FORMING APPARATUS THAT PREVENTS IMAGE DEFECTS AND REDUCES FIRST COPY OUTPUT TIME

BACKGROUND OF THE INVENTION

Field of the invention

The subject disclosure relates to an electrophotographic image forming apparatus.

Description of the Related Art

In an electrophotographic image forming apparatus, after a surface of an image bearing member such as a photosensitive drum is charged, toner images formed through an exposure process and a development process are transferred to a recording medium directly or indirectly through an intermediate transfer member to form an image on the recording medium. A charging process and a transferring process are executed when a bias voltage is applied from a high-voltage circuit board to a charging member and a transfer member that face the image bearing member. In many cases, output of a charging bias is started before output of a transfer bias is started, and the output of the transfer bias is started while the charging bias is stable. This is because a surface potential in a partial region of the photosensitive drum is prevented from changing to a polarity opposite to a polarity of the charging bias due to a transfer current flowing between the photosensitive drum and the transfer member by the transfer bias. If the surface potential of the photosensitive drum is changed to the polarity opposite to the polarity of the charging bias, charging potential unevenness (charging unevenness) occurs in the following charging process, which may cause image defect such as horizontal stripes.

On the other hand, in the image forming apparatus, a time period after printing start operation such as pressing of a copy button is performed by a user until a first recording medium on which the image has been formed is discharged, is called a first copy output time (FCOT). It is desired to reduce the FCOT as much as possible because the user waits for the time period of the FCOT.

Japanese Patent Application Laid-Open No. 2014-170156 discusses an image forming apparatus in which output of the transfer bias is started at a time when a surface position of the photosensitive drum at which the charging by the charging roller is started reaches a transfer position by a primary transfer roller, thereby reducing the FCOT. The image forming apparatus controls the output of the transfer bias through pulse width modulation, and a duty radio of the transfer bias is set to a value smaller than a regular set value during a predetermined period at the beginning of raising. This prevents a transfer current from overshooting in raising of the transfer bias, and to prevent the charging unevenness from remaining as a history of the overshooting in the following charging process.

In the transfer member such as the transfer roller and the charging member such as the charging roller, impedance is varied due to difference of conditions such as use environment and a cumulative use time. Accordingly, a time after the output of the charging bias and the output of the primary transfer bias are started until the output reaches a target voltage value or a target current value is different depending on the conditions. The configuration discussed in Japanese Patent Application Laid-Open No. 2014-170156, however, is not made in consideration of such condition difference, and the charging unevenness accordingly occurs in some cases. In other words, in a case where a rising speed of the charging bias is relatively low and a rising speed of the transfer bias is relatively high, an excess transfer current may flow through the surface region of the photosensitive drum that has not been sufficiently charged, which causes the surface potential to become the polarity opposite to the polarity of the charging bias.

SUMMARY OF THE INVENTION

The subject disclosure is directed to an image forming apparatus that can prevent image defect such as horizontal stripes due to charging unevenness and to reduce a first copy output time (FCOT).

According to an aspect of the disclosure, an image forming apparatus includes an image bearing member that to rotates a charging member facing the image bearing member and forms a charging portion between the charging member and the image bearing member, a charging bias output portion that output a charging bias to the charging member to charge a surface of the image bearing member at the charging portion, a transfer member facing the image bearing member that forms, between the transfer member and the image bearing member, a transfer portion at which a toner image borne on the image bearing member is transferred to a transferred medium, a transfer bias output portion that outputs a transfer bias to the transfer member, to transfer the toner image borne on the image bearing member to the transferred medium at the transfer portion, a current detection circuit that detects a transfer current flowing through the transfer portion, and a control portion that to controls the charging bias output portion and the transfer bias output portion. The control portion starts output of the transfer bias output portion after a leading end of a charging raising region passes through the transfer portion and before a trailing end of the charging raising region passes through the transfer portion, the charging raising region being a region of the image bearing member that passes through the charging portion during a charging raising period after output of the charging bias output portion is started along with start of image formation until the charging bias output by the charging bias output portion reaches a target charging bias set during an image forming time. The control portion controls a transfer current flowing through the transfer portion to a predetermined current at a predetermined timing, based on a result of detection by the current detection circuit, during a transfer raising period after output of the transfer bias output portion is started along with the start of the image formation until the transfer bias output by the transfer bias output portion reaches a target transfer bias set during the image forming time.

Further features and various aspects of the disclosure will become apparent from the following description of multiple example embodiments with reference to the attached drawings.

DESCRIPTION OF THE EMBODIMENTS

A full-color printer as an example of an image forming apparatus is described below with reference to drawings. The image forming apparatus, however, is not limited to the full-color image forming apparatus, and may be a monochrome or mono-color image forming apparatus. Alternatively, the image forming apparatus may be implemented in various applications such as a printer, various kinds printing apparatuses, a copying machine, a facsimile (FAX) machine, and a multifunction peripheral (MFP).

Figure 1:
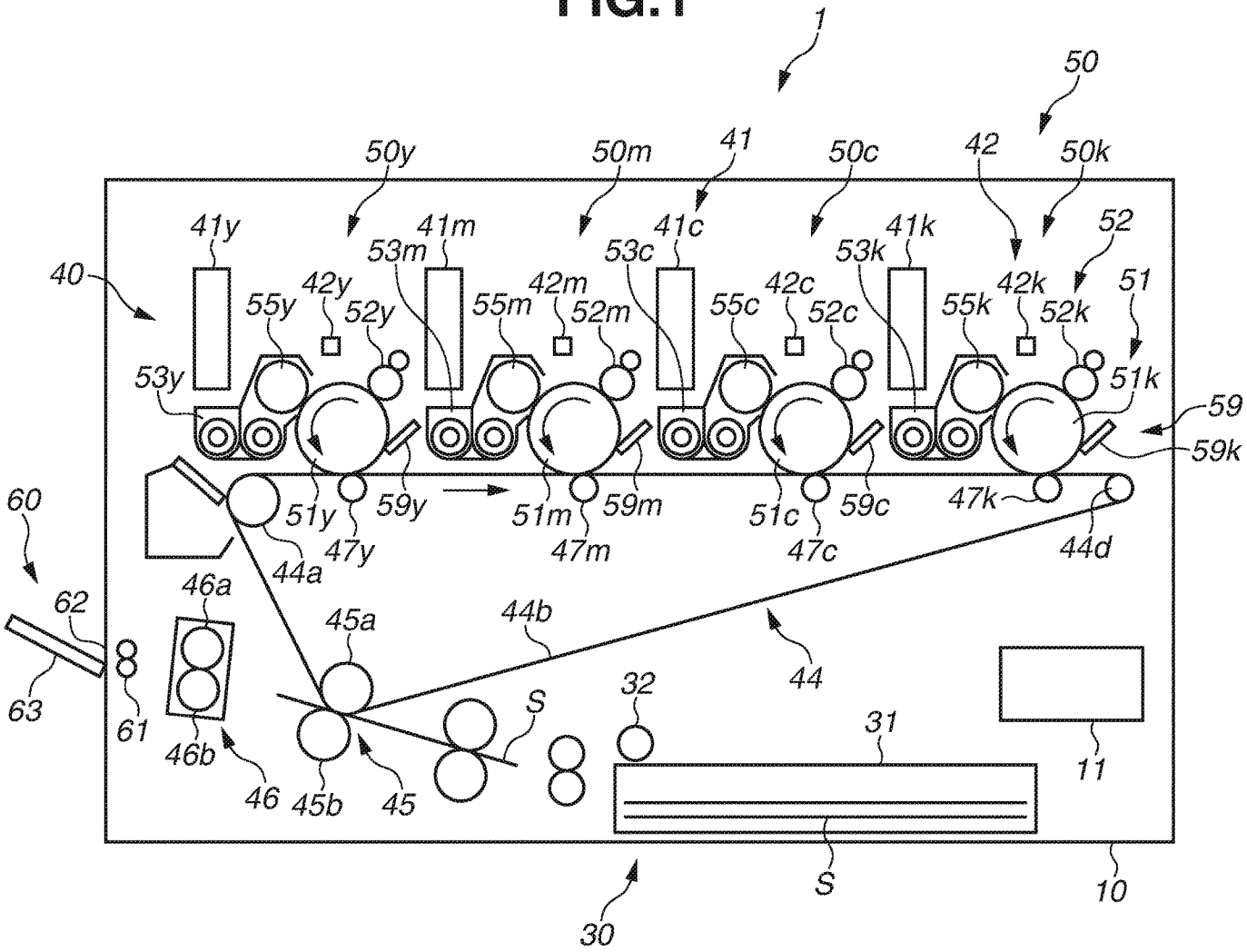
FIG. 1 is a schematic diagram illustrating a configuration of an image forming apparatus according to a first example embodiment.

As illustrated in FIG. 1, an image forming apparatus 1 includes an electrophotographic image forming section 40, and forms an image on a recording medium S based on image information provided from an external personal computer (PC) and image information read from a document. The image forming apparatus 1 includes an apparatus main body 10, a sheet feeding unit 30, the image forming section 40, sheet discharging unit 60, and a control unit (control portion) 11. Specific examples of the recording medium S as a recording medium on which toner images are to be formed include a plain paper, a synthetic resin sheet as a substitute for the plain paper, a thick paper, and an overhead proprojector sheet. The sheet feeding unit 30 is disposed at a lower part of the apparatus main body 10, includes a sheet cassette 31 in which the recording medium S is accommodated, and a feeding roller 32, and feeds the recording medium S to the image forming section 40.

The image forming section 40 includes image forming units 50*y*, 50*m*, 50*c*, and 50*k*, toner bottles 41*y*, 41*m*, 41*c*, and 41*k*, exposure devices 42*y*, 42*m*, 42*c*, and 42*k*, an intermediate transfer unit 44, a secondary transfer unit 45, and a fixing unit 46. The image forming apparatus according to the present example embodiment supports full color, and the image forming units 50*y*, 50*m*, 50*c*, and 50*k* are respectively provided separately with similar configurations for four colors of yellow (y), magenta (m), cyan (c), and black (k). Accordingly, a corresponding color identifier is added to the same reference numeral at the end thereof for the unit of each of the four colors in FIG. 1. However, the configurations of four colors are described only with the reference numerals without adding the color identifiers in FIG. 2 and subsequent drawings and the description of the specification corresponding to these drawings.

The image forming units 50*y*, 50*m*, 50*c*, and 50*k* each form a toner image of the corresponding color through electrophotographic processes. In other words, photosensitive drums 51*y*, 51*m*, 51*c*, and 51*k* serving as photosensitive members are charged and are then exposed to form electrostatic latent images, and the electrostatic latent images are developed by developers to form toner images. The toner images borne on the photosensitive drums 51*y*, 51*m*, 51*c*, and 51*k* are primarily transferred to an intermediate transfer belt 44*b* serving as a transferred medium by primary transfer rollers 47*y*, 47*m*, 47*c*, and 47*k*, respectively. Residues such as transfer residual toner remaining on the surfaces of the respective photosensitive drums 51*y*, 51*m*, 51*c*, and 51*k* are respectively cleaned by cleaning blades 59*y*, 59*m*, 59*c*, and 59*k* each brought into contact with the surface of the corresponding photosensitive drum.

The intermediate transfer unit 44 includes a plurality of rollers that includes a drive roller 44*a*, a driven roller 44*d*, and the primary transfer rollers 47*y*, 47*m*, 47*c*, and 47*k*, and the intermediate transfer belt 44*b* that is wound around the rollers. The primary transfer rollers 47*y*, 47*m*, 47*c*, and 47*k* are disposed to respectively face the photosensitive drums 51*y*, 51*m*, 51*c*, and 51*k*, and come into contact with an inner peripheral surface of the intermediate transfer belt 44*b*. The toner image multiple-transferred onto the intermediate transfer belt 44*b* by the primary transfer rollers 47*y*, 47*m*, 47*c*, and 47*k* is conveyed toward the primary transfer unit 45 by the intermediate transfer belt 44*b*.

The secondary transfer unit 45 includes a secondary inner transfer roller 45*a* and a secondary outer transfer roller 45*b*, and performs secondary transfer at a nip portion between the secondary inner transfer roller 45*a* and the secondary outer transfer roller 45*b*. The secondary inner transfer roller 45*a* is in contact with the inner peripheral surface of the intermediate transfer belt 44*b*, and the secondary outer transfer roller 45*b* is in contact with an outer peripheral surface of the intermediate transfer belt 44*b*. More specifically, the toner image borne on the intermediate transfer belt 44*b* serving as an intermediate transfer member is transferred onto the recording medium S as a transferred medium when a secondary transfer bias voltage having a polarity opposite to the charging polarity of the toner image is applied to the secondary outer transfer roller 45*b*. The fixing unit 46 includes a fixing roller 46*a*, a pressurizing roller 46*b*, and a heat source (not illustrated). The toner image transferred onto the recording medium S is held and conveyed between the fixing roller 46*a* and the pressurizing roller 46*b* to be heated and pressurized, thereby being fixed to the recording medium S.

The sheet discharge unit 60 includes a discharge roller pair 61, a discharge port 62, and a discharge tray 63. The discharge roller pair 61 is disposed downstream in a discharge path. The discharge port 62 and the discharge tray 63 are disposed on the side surface of the apparatus main body 10. The discharge roller pair 61 feeds, from the nip portion, the recording medium S convened through the discharge path, and discharges the recording medium S through the discharge port 62. The recording medium S discharged through the discharge port 62 is stacked on the discharge tray 63.

<Image Forming Processing>

Next, example configurations of the respective image forming units 50*y*, 50*m*, 50*c*, and 50*k* and image forming operation in which the image forming units 50*y*, 50*m*, 50*c*, and 50*k* form the toner images and the toner images are transferred to the transferred medium are described with reference to FIG. 2. The configurations of the respective image forming units are substantially similar to one another except that colors of the toner used for development are different from one another. Therefore, the following description, an image forming unit 50 that is usable as any of the above-described image forming units 50*y*, 50*m*, 50*c*, and 50*k* is described.

Figure 2:
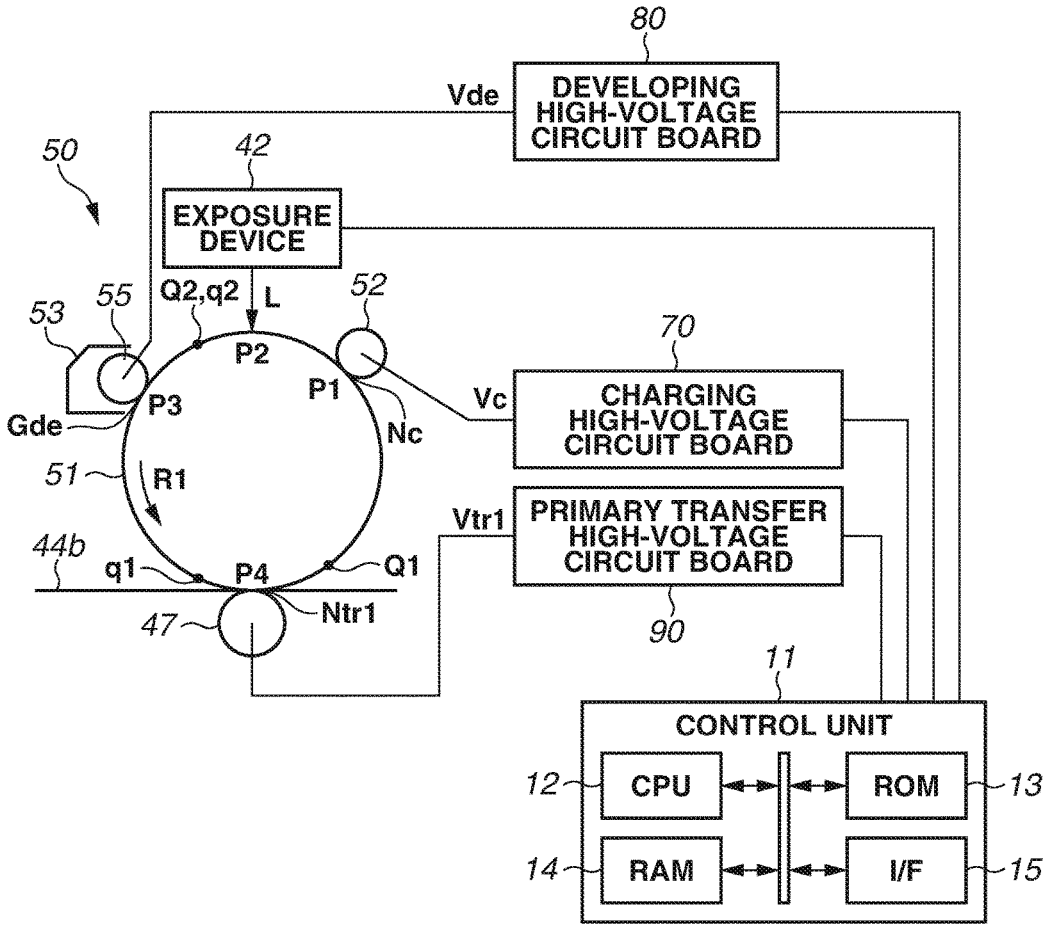
FIG. 2 is a schematic diagram illustrating a configuration of a process unit according to the first example embodiment.

As illustrated in FIG. 2, the image forming unit 50 includes a photosensitive drum 51 serving as an image bearing member, a charging roller 52 serving as a charging member, an exposure device 42 serving as an exposure unit, and a developing device 53 serving as a developing unit. The photosensitive drum 51 is driven by a drum motor (not illustrated) to rotate in a direction (arrow R1) the same as a moving direction of the intermediate transfer belt 44*b*, and the charging roller 52 is also driven to rotate in a direction the same as the rotation direction of the photosensitive drum 51.

The photosensitive drum 51 includes, on an outer peripheral surface of an aluminum cylinder, a photosensitive layer that has a negative charging polarity, and rotates in the arrow R1 direction at a predetermined process speed (circumferential velocity). A charging high-voltage circuit board 70 is connected to the charging roller 52, and a charging bias voltage (hereinafter, charging bias) Vc described below is applied to the charging roller 52 from the charging high-voltage circuit board 70. The charging roller 52 is in contact with the surface of the photosensitive drum 51, and forms a charging nip Nc between the charging roller 52 and the photosensitive drum 51, as a charging portion at which charging of the photosensitive drum 51 is performed. The charging roller 52 is applied with the charging bias Vc output from the charging high-voltage circuit board 70 as a charging bias output unit, thereby uniformly charging the surface of the photosensitive drum 51 at the charging nip Nc. In the present example embodiment, description is given assuming that the charging high-voltage circuit board outputs the charging bias containing a direct-current component and an alternating-current component. However, the charging high-voltage circuit board 70 may output the charging bias containing only a direct-current component.

Thereafter, the photosensitive drum 51 is irradiated with a laser beam L by the exposure device 42, and is accordingly exposed. In other words, the exposure device 42 causes a laser diode serving as a light source to emit light by a driver circuit, and performs scanning with the laser beam L from the light source in an axial direction (main scanning direction) of the photosensitive drum 51, thereby exposing the charged surface of the photosensitive drum 51 rotating in the arrow R1 direction (sub-scanning direction). As a result, the electrostatic latent image based on the image information is written on the surface of the photosensitive drum 51, and the electrostatic latent image is moved toward the developing device 53 along with rotation of the photosensitive drum 51.

The developing device 53 includes a developer container for containing developer, and a developing sleeve that is disposed at an opening of the developer container. The developing sleeve 55 serving as a developer bearing member is connected to a developing high-voltage circuit board 80, and a developing bias voltage (hereinafter, developing bias) Vde that contains a direct-current component (hereinafter, developing DC) having the same polarity as the charging polarity of the toner contained in the developer is applied to the developing sleeve 55. In the present example embodiment, description is given assuming that two-component developer including magnetic carrier having positive charging characteristics and non-magnetic toner having negative charging characteristics is used. However, other developing methods such as a one-component developing method and a liquid developing method using magnetic toner may be used.

The developing sleeve 55 faces the photosensitive drum 51 with a predetermined distance in between, and forms, as a space (gap) with the photosensitive drum 51, a developing portion Gde at which development is performed. When the high-voltage developing bias Vde is applied to the developing sleeve 55, the negatively-charged toner is electrostatically absorbed, at the developing portion Gde, to a region (bright region) of the electrostatic latent image that is positive relative to the developing sleeve and is negative relative to the ground potential. As a result, the electrostatic latent image is developed to the toner image. In other words, the developing device 53 visualizes the electrostatic latent image borne on the photosensitive member with use of the developing bias Vde output from the developing high-voltage circuit board 80 serving as a developing bias output unit.

The primary transfer roller 47 serving as a transfer member is in contact with the inner peripheral surface of the intermediate transfer belt 44*b*, and forms a transfer nip Ntr1 as a transfer portion at which transfer (primary transfer) of the toner image is performed, between the outer peripheral surface of the intermediate transfer belt 44*b* and the photosensitive drum 51. The primary transfer roller 47 is connected to a primary transfer high-voltage circuit board 90. The primary transfer high-voltage circuit board 90 outputs a primary transfer bias Vtr1 that is a transfer bias voltage having a polarity opposite to the charging polarity of the toner, and supplies the primary transfer bias Vtr1 to the primary transfer roller 47. When the primary transfer bias Vtr1 is applied to the primary transfer roller 47, toner particles are electrostatically pulled toward the primary transfer roller 47 at the transfer nip Ntr1, and the toner image borne on the photosensitive drum 51 is transferred to the intermediate transfer belt 44*b*. In other words, the primary transfer roller 47 primarily transfers the toner image borne on the photosensitive member, to the intermediate transfer member with use of the primary transfer bias Vtr1 output from the primary transfer high-voltage circuit board 90 serving as a transfer bias output unit.

In the following description, a position of the charging nip Nc is referred to as a charging position P1, a position of the photosensitive drum 51 to be irradiated with the laser beam L is referred to as an exposure position P2, a position of the developing portion Gde is referred to as a developing position P3, and a position of the transfer nip Ntr1 is referred to as a transfer position P4. The image forming operation by the image forming unit is performed when each surface position of the photosensitive drum 51 sequentially passes through the charging position p1, the exposure position P2, the developing position P3, and the transfer position P4.

The operation of the image forming unit 50 is controlled by a control unit 11 that is an example of a control means. The control unit 11 includes a computer, and is mounted on the apparatus main body 10 of the image forming apparatus 1 (see FIG. 1). The control unit 11 includes, for example, a central processing unit (CPU) 12, a read only memory (ROM) 13 storing a control program, a random access memory (RAM) 14 temporarily storing data, and an input/output circuit (I/F) 15 that inputs and outputs signals from and to outside. The CPU 12 is a microprocessor that controls the entire image forming apparatus 1, and is a main part of a system controller. The CPU 12 executes a program read from the ROM 13 to exchange signals with the sheet feeding unit 30, the image forming section 40, and the sheet discharge unit 60 via the I/F 15 and control the operation thereof.

Further, the control unit 11 exchanges signals with the charging high-voltage circuit board 70, the developing high-voltage circuit board 80, and the primary transfer high-voltage circuit board 90 to control the charging bias Vc, the developing bias Vde, and the primary transfer bias Vtr1 respectively provided from these circuit boards. Moreover, the control unit 11 transmits, as a video signal, the image information to be formed as an image to the exposure device 42, and causes the exposure device 42 to execute writing of the electrostatic latent image. A method of high-voltage raising control to raise an output of each of the charging high-voltage circuit board 70, the developing high-voltage circuit board 80, and the primary transfer high-voltage circuit board 90 when the control unit 11 starts an image forming job, is described in detail below.

Further, the control unit 11 performs, in an appropriate period during a non-image forming time, adjustment control to calculate the primary transfer bias Vtr1 to be output to the primary transfer roller 47 at an image forming time. In other words, a value of the primary transfer bias Vtr1 is set in such a manner that a magnitude of the transfer current measured while the toner image is not borne an the photosensitive drum 51 becomes a preset target current value. The transfer current indicates a current flowing between the photosensitive member and the transfer member at the transfer portion. In the present example embodiment, the transfer current corresponds to a current (hereinafter, primary transfer current) flowing between the photosensitive drum 51 and the primary transfer roller 47 at the transfer nip Ntr1. Further, the image forming time indicates a period during which the image forming operation is performed based on the image information input from an external terminal of a scanner and a personal computer provided on the image forming apparatus 1, i.e., a period during which the toner image is formed on the photosensitive member and the toner image is transferred to the transferred medium. On the other hand, the non-image forming time indicates a period other than the image forming time, and indicates, for example, a period between a period in which the toner image to be transferred to a preceding sheet is formed and a period in which the toner image to be transferred to a following sheet is formed (so-called sheet-to-sheet interval) during the execution of the image forming job, or a period for waiting for input of the image forming job.

<High-Voltage Circuit Board>

Next, an example configuration of each of power supply circuit boards such as the charging high-voltage circuit board 70, the developing high-voltage circuit board 80, and the primary transfer high-voltage circuit board 90 that each supply a high voltage to the process components around the photosensitive drum 51 of the image forming apparatus 1, is described with reference to FIGS. 3 to 5.

Figure 3:
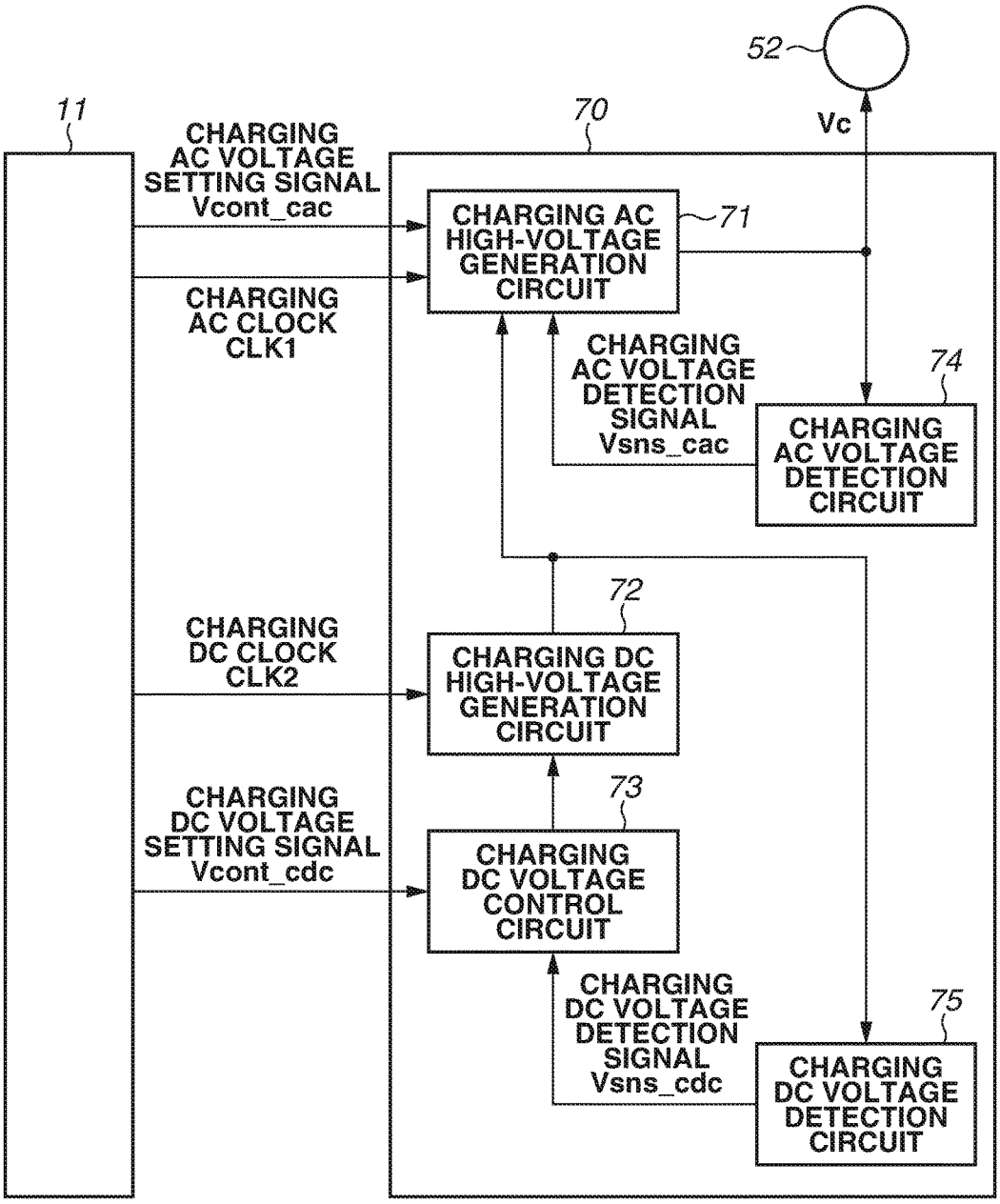
FIG. 3 is a block diagram illustrating a configuration of a charging high-voltage circuit board of the image forming apparatus according to the first example embodiment.

As illustrated in FIG. 3, the charging high-voltage circuit board 70 includes a charging AC high-voltage generation circuit 71, a charging DC high-voltage generation circuit 72, a charging DC voltage control circuit 73, a charging AC voltage detection circuit 74, and a charging DC voltage detection circuit 75. The charging high-voltage circuit board 70 outputs the charging bias Vc based on a signal from the control unit 11, and supplies the charging bias Vc to the charging roller 52. The charging bias Vc is obtained by superposing an alternating-current component (hereinafter, referred to as charging AC) generated by the charging AC high-voltage generation circuit 71 and a direct-current component (hereinafter, referred to as charging DC) generated by the charging DC high-voltage generation circuit 72.

The control unit 11 outputs, to the charging high-voltage circuit board 70, a charging AC voltage setting signal Vcont_cac for setting a peak-to-peak voltage (Vpp) of the charging AC high voltage, and a charging AC clock CLK1 for determining a frequency of a waveform of the charging AC high voltage. In addition, the control unit 11 outputs, to the charging high-voltage circuit board 70, a charging DC clock CLK2 for driving a transformer (not illustrated) of the charging DC high-voltage generation circuit 72, and a charging DC voltage setting signal Vcont_cdc for setting a voltage value of the DC high voltage of the charging high-voltage circuit board 70.

The charging DC voltage control circuit 73 performs feedback control on the charging DV high-voltage generation circuit 72 so that the charging DC voltage setting signal Vcont_cdc and a charging DC voltage detection signal Vsns_cdc detected by the charging DC voltage detection circuit 75 are coincident with each other. The charging DV voltage detection circuit 75 detects an output voltage of the charging DC high-voltage generation circuit 72, and provides the charging DC voltage detection signal Vsns_cdc to the charging DC voltage control circuit 73. The charging DC high-voltage generation circuit 72 drives a primary side of the not-illustrated transformer based on the charging DC clock CLK2, and generates and outputs the charging DC as a direct-current voltage having a negative potential of the voltage value set by the charging DC voltage setting signal Vcont_cdc.

The charging AC high-voltage generation circuit outputs the charging AC as an alternating-current voltage of a sine wave having an amplitude set by the charging AC voltage setting signal Vcont_cac at a frequency f the charging AC clock CLK1. The charging AC voltage detection circuit 74 detects the peak-to-peak voltage Vpp of the charging AC output from the charging AC high-voltage generation circuit 71, and outputs the charging AC voltage detection signal Vsns_cac of the alternating-current voltage corresponding to the value of the peak-to peak voltage Vpp, to the charging AC high-voltage generation circuit 71. The charging AC high-voltage generation circuit 71 performs feedback control so that the charging AC voltage setting signal Vcont_cac and the input charging AC voltage detection signal Vsns_cac are coincident with each other, and outputs a voltage obtained by superposing the direct-current voltage and the alternating-current voltage, to the charging roller 52.

Figure 4:
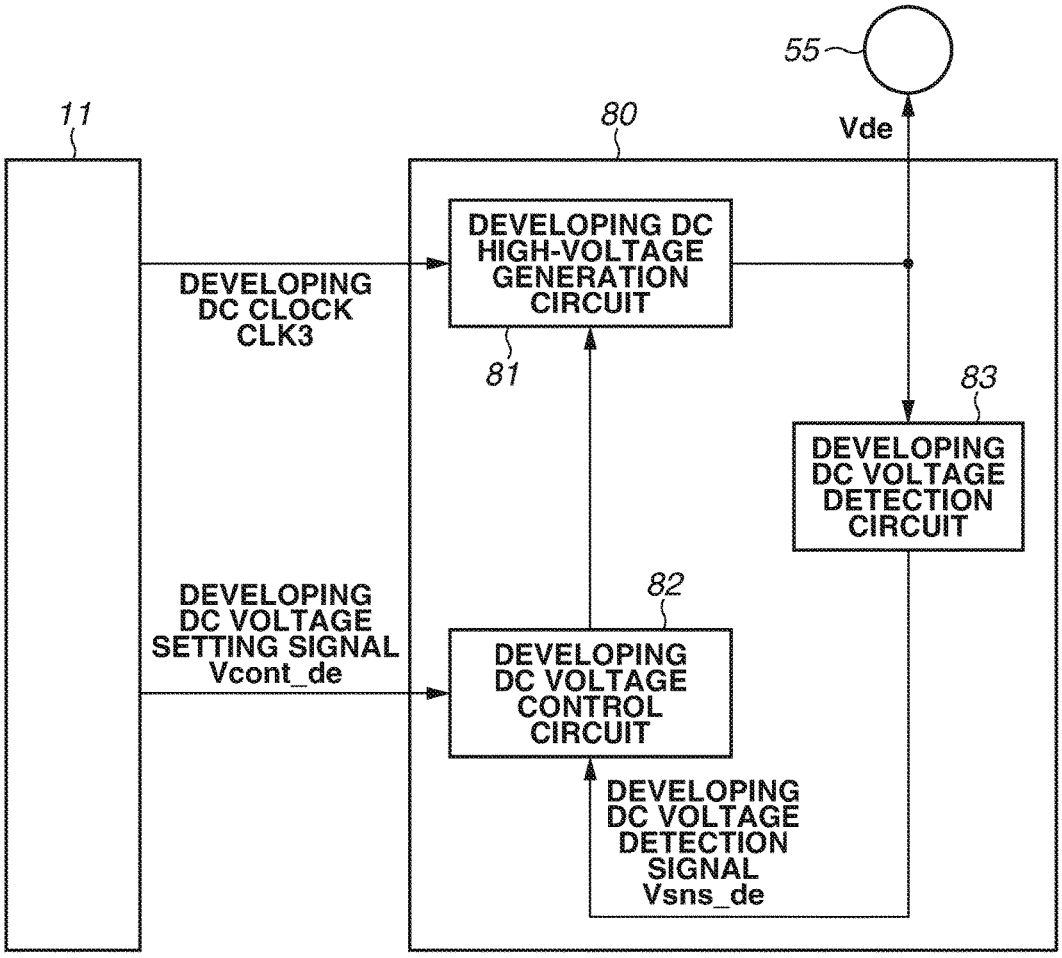
FIG. 4 is a block diagram illustrating a configuration of a developing high-voltage circuit board of the image forming apparatus according to the first example embodiment.

As illustrated in FIG. 4, the developing high-voltage circuit board 80 includes a developing DC high-voltage generation circuit 81, a developing DC voltage control circuit 82, and a developing DC voltage detection circuit 83, and outputs the developing bias Vde having a negative potential based on the signal from the control unit 11 and supplies the developing bias Vde to the developing sleeve 55.

The control unit 11 outputs, to the developing high-voltage circuit board 80, a developing DC clock CLK3 that drives a transformer (not illustrated) of the developing DC high-voltage generation circuit 81, and a developing DC voltage setting signal Vcont_de that sets a voltage value of the developing DC output by the developing high-voltage circuit board 80. The developing DC high-voltage generation circuit 81 drives a primary side of the not-illustrated transformer based on the developing DC clock CLK3, and generates and outputs the developing DC of a voltage set by the developing DC voltage setting signal Vcont_de. The developing DC voltage detection circuit 83 detects an output voltage of the developing DC high-voltage generation circuit 81, and inputs the developing DC voltage detection signal Vsns_de to the developing DC voltage control circuit 82. The developing DC voltage control circuit 82 performs feedback control on the developing DC high-voltage generation circuit 81 so that the developing DC voltage setting signal Vcont_de and the developing DC voltage detection signal Vsns_de detected by the developing DC voltage detection circuit 83 are coincident with each other.

Figure 5:
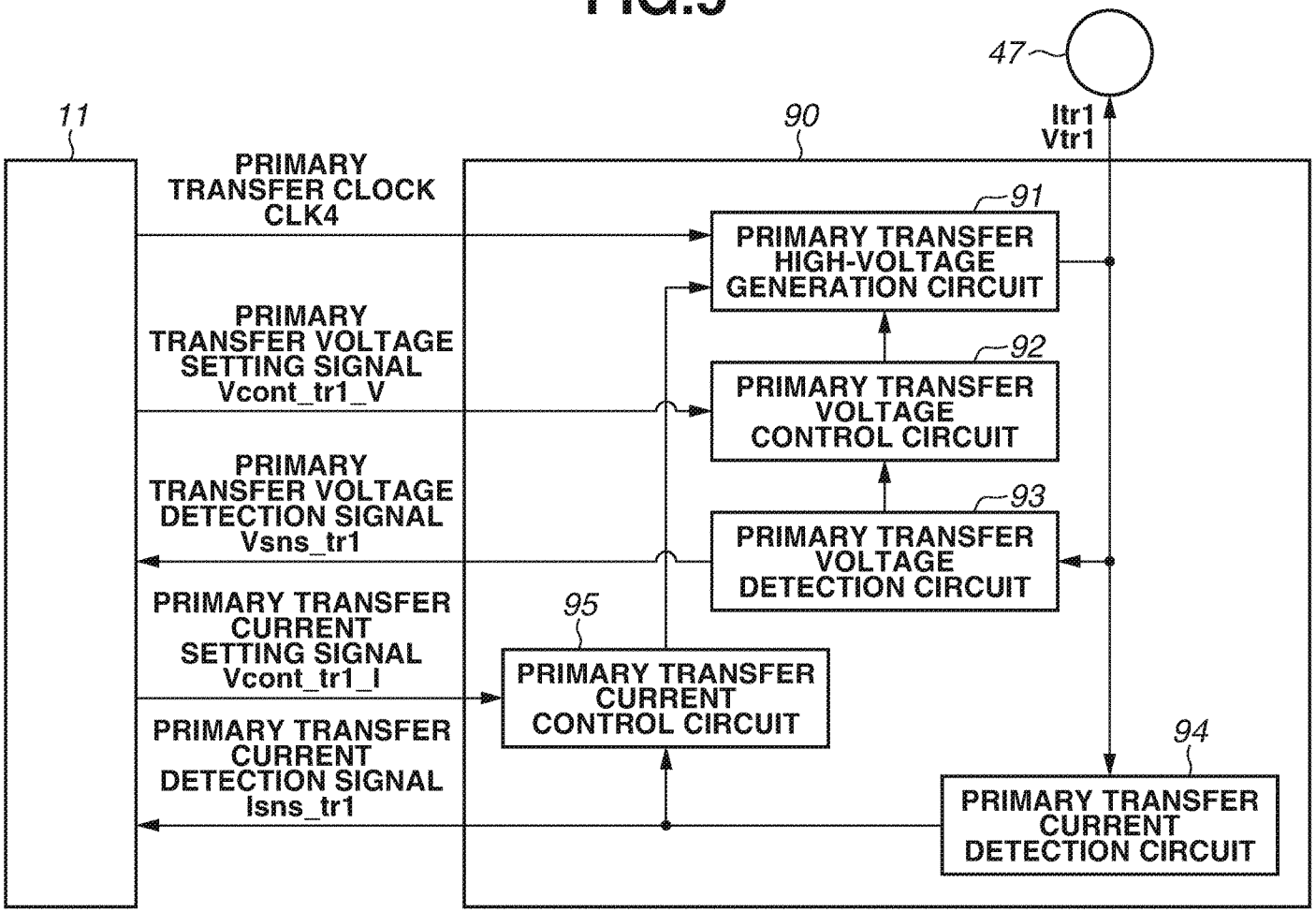
FIG. 5 is a block diagram illustrating a configuration of a primary transfer high-voltage circuit board of the image forming apparatus according to the first example embodiment.

As illustrated in FIG. 5, the primary transfer high-voltage circuit board 90 includes a primary transfer high-voltage generation circuit 91, a primary transfer voltage control circuit 92, a primary transfer voltage detection circuit 93, a primary transfer current detection circuit 94, and a primary transfer current control circuit 95. The primary transfer high-voltage circuit board 90 (an example of a voltage generation circuit) outputs the primary transfer bias Vtr1 containing the direct-current component based on the signal from the control unit 11, and supplies a primary transfer current Itr1 to the primary transfer roller 47.

The control unit 11 outputs, to the primary transfer high-voltage circuit board 90, a primary transfer clock CLK4 that drives a transformer (not illustrated) of the primary transfer high-voltage generation circuit 91. Further, the control unit 11 outputs, to the primary transfer high-voltage circuit board 90, a primary transfer voltage setting signal Vcont_tr1_V that sets a voltage value of the primary transfer bias, or a primary transfer current setting signal Vcont_tr1_I that sets a current value of the primary transfer current.

The primary transfer high-voltage circuit board 90 can switch between constant voltage control to control the primary transfer bias Vtr1 so as to be coincident with the set voltage value and constant current control to control the primary transfer bias Vtr1 so that the primary transfer current Itr1 is coincident with the set current value. In a case of the constant voltage control, the primary transfer voltage control circuit 92 performs feedback control on the primary transfer high-voltage generation circuit 91 so that the primary transfer voltage setting signal Vcont_tr1_V and the primary transfer voltage detection signal Vsns_tr1 detected by the primary transfer voltage detection circuit 93 are coincident with each other. In a case of the constant current control, the primary transfer current control circuit 95 performs feedback control on the primary transfer high-voltage generation circuit 91 so that the primary transfer current setting signal Vcont_tr1_I and a primary transfer current detection signal Isns_tr1 detected by the primary transfer current detection circuit 94 are coincident with each other.

The primary transfer voltage detection circuit 93 detects an output voltage of the primary transfer high-voltage generation circuit 91, and provides the primary transfer voltage detection signal Vsns_tr1 to the primary transfer voltage control circuit 92 and the control unit 11. In the constant voltage control, the primary transfer high-voltage generation circuit 91 drives a primary side of the not-illustrated transformer based on the primary transfer clock CLK4, and generates and outputs the primary transfer bias of the voltage set by the primary transfer voltage setting signal Vcont_tr1_V.

The primary transfer current detection circuit 94 can detect the current flowing through the primary transfer roller 47, and detects the output current of the primary transfer high-voltage circuit board 90 while the image forming apparatus 1 does not form an image, and outputs the primary transfer current detection signal Isns_tr1 to the control unit 11. In the constant current control, the primary transfer high-voltage generation circuit 91 drives the primary side of the not-illustrated transformer based an the primary transfer clock CLK4, and generates and outputs the primary transfer bias to cause the primary transfer current set by the primary transfer current setting signal Vcont_tr1_I to flow In the present example embodiment, the control unit 11 performs active transfer voltage control (ATVC) in which the constant voltage control is performed at the image forming time, with use of detection results of the current and the voltage when a predetermined current flows at the non-image forming time. In other words, the control unit 11 estimates a resistance value (current-voltage characteristics) of the primary transfer roller 47 from the primary transfer voltage detection signal Vsns_tr1 detected when the current set by the primary transfer current setting signal Vcont_tr1_I is output. The control unit 11 then calculates the set value of the primary transfer bias Vtr1 to be applied to the primary transfer roller 47 during the image forming time, based on the estimated resistance value.

More specifically, the control unit 11 outputs, to a non-image part (e.g., region corresponding to sheet-to-sheet interval) of the photosensitive drum 51, the primary transfer bias Vtr1 while performing the constant current control so that the primary transfer current of the previously-set current value flows through the transfer nip Ntr1. Then, the control unit 11 calculates the resistance value of the primary transfer roller 47 from the set current value at this time and the voltage value applied to the primary transfer roller 47, and performs the constant voltage control on the primary transfer high-voltage circuit board 90 with the voltage value that is determined in consideration of use environment and a durable situation of the image forming apparatus 1, during the image forming time. The constant voltage control is performed on the primary transfer bias Vtr1 during the image forming time, which makes intensity of a bias electric field of the transfer nip Ntr1 substantially constant even if load variation occurs at the transfer nip Ntr1, and improves the stability of image quality.

<Operation in Comparative Configuration>

Before the description of the high-voltage raising control of each of the high-voltage circuit boards according to the present example embodiment, high-voltage raising control in a comparative configuration (hereinafter, "comparative configuration") is described with reference to FIG. 10. An image forming apparatus in the comparative configuration has a configuration similar to the configuration of the present example embodiment except for operation in raising, and executes the ATVC during the non-image forming time and calculates a target value of the primary transfer bias to be applied to the primary transfer roller during the image forming time, as with the present example embodiment. Accordingly, the target value of the primary transfer bias (e.g., any of 1000 V, 1500 V, and 2000 V) is determined at a time point before the start of the high-voltage raising control in FIG. 10.

Figure 10:
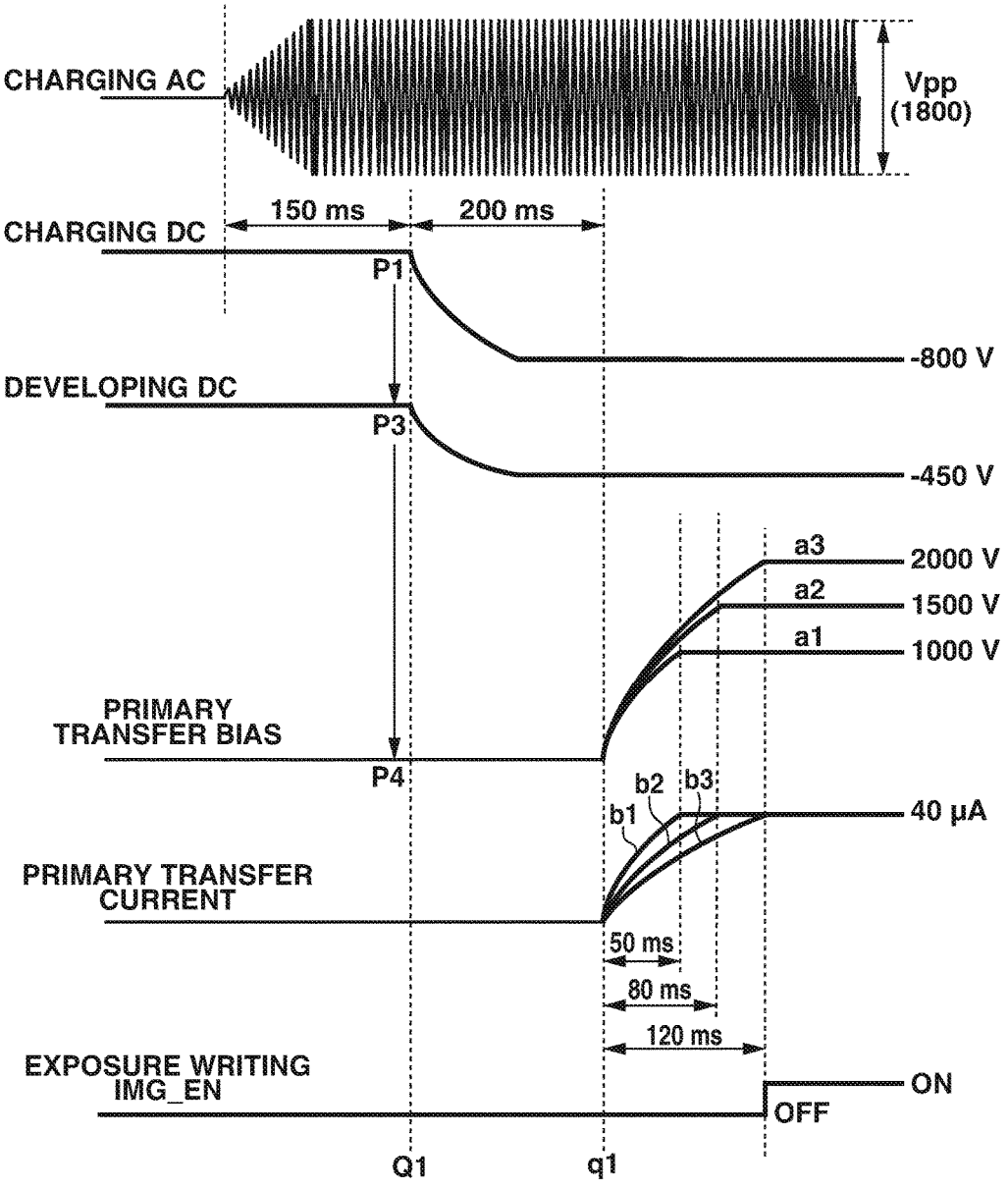
FIG. 10 is a timing chart illustrating outputs of respective high-voltage circuit boards in a comparative configuration, with surface positions of a photosensitive drum as reference.

FIG. 10 is a timing chart illustrating outputs of the respective high-voltage circuit boards and the like in the comparative configuration with the surface positions of the photosensitive drum as reference. A horizontal axis of FIG. 10 indicates a time, and output waveforms of the respective high voltages are illustrated in such a manner that the output values applied to the same position on the circumference of the surface of the photosensitive drum are illustrated at the same coordinate in the horizontal axis. For example, in FIG. 10, a position of timing when output of the charging DC is started and a position of timing when output of the developing DC is started are aligned in the horizontal axis. This indicates that the output of the developing DC is started at a time when the photosensitive drum 51 rotates by phase difference between the charging nip Nc and the developing portion Gde after the output of the charging DC is started, with reference to FIG. 2. In other words, each chart in FIG. 10 is illustrated at a position shifted from an actual time axis according to an angle difference between points at which the respective processes of the image forming processing are performed and angular velocity of the photosensitive drum.

As illustrated in FIG. 10, in the high-voltage raising control in the comparative configuration, the output of the charging AC is first started, and the output of the charging DC is started after 150 ms from the output start of the charging AC. At this time, the target voltage value of the charging DC is set to −800 V that is the same as the target voltage value in the image forming time, at the time of the output start. It is known that the charging DC rises to −800 V within 200 ms from the output start in consideration of impedance variation of the charging roller in consideration of use environment, a durability situation of the image forming apparatus. Further, the output of the developing DC is started at a timing when the surface position of the photosensitive drum that has passed through the charging position P1 at the same time as the output start of the charging DC reaches the developing position P3, and the developing DC rises to −450 V that is the target voltage value, within 200 ms from the output start. Furthermore, the output of the primary transfer bias is started at a timing after 200 ms since the surface position of the photosensitive drum that has passed through the developing position P3 at the same time as the output start of the developing DC reaches the transfer position P4.

The trigger signal IMG_EN instructing start of the image forming operation is output from the control unit at a timing after 120 ms from the output start of the primary transfer bias. The time of 120 ms is an estimated time necessary for stabilization of the primary transfer bias at the target voltage value obtained by the ATVC. The trigger signal IMG_EN is a signal that instructs the exposure device to perform writing operation in which the surface of the photosensitive drum is exposed to the laser beam L to write the electrostatic latent image.

In the image forming apparatus, the estimated time from the output start of the primary transfer bias until the primary transfer bias becomes stable at the target voltage value obtained by the ATVC is 120 ms for the following reason. The target voltage value of the primary transfer bias output by the primary transfer high-voltage circuit board is set so that the primary transfer current becomes a predetermined value (e.g., 40 μA). The waveforms (rising waveforms) of the primary transfer bias and the primary transfer current from the output start of the primary transfer bias until the primary transfer current reaches the predetermined value are each different due to variation of the impedance of the primary transfer roller that is caused by the use environment, the durability situation, and the like of the image forming apparatus.

FIG. 10 illustrates rising waveforms b1, b2, and b3 of the transfer current in cases where the impedance of the primary transfer roller is minimum, normal, and maximum. Minimum, normal, and maximum of the impedance are evaluations within an estimated range with a normal usage consideration of the use environment, the durability situation, and the like of the image forming apparatus. In the case where the impedance of the primary transfer roller is small (b1), the time from the output start of the primary transfer bias until the value of the primary transfer current becomes stable at 40 μA is 50 ms. In other words, the primary transfer bias reaches the target voltage value of 1000 V (a1) at a time of 50 ms after the output start. In the case where the impedance of the primary transfer roller is normal (b2), the time from the output start of the primary transfer bias until the value of the primary transfer current becomes stable at 40 μA is 80 ms. In other words, the primary transfer bias reaches the target voltage value of 1500 V (a2) at a time of 80 ms after the output start. In the case where the impedance of the primary transfer roller is large (b3), the time from the output start of the primary transfer bias until the value of the primary transfer current becomes stable at 40 μA is 120 ms. In other words, the primary transfer bias reaches the target voltage value of 2000 V (a3) at a time of 120 ms after the output start.

As described above, in the comparative configuration, it takes up to about 120 ms until the primary transfer bias reaches the target voltage value due to variation of the impedance of the primary transfer roller. In consideration of such variation of the impedance of the primary transfer roller and the like, the estimated time from the output start of the primary transfer bias until the primary transfer bias reaches the target voltage value is set to 120 ms in anticipation f the lowest rising case (b3).

<High-Voltage Raising Control in Present Example Embodiment>

Next, operation to raise the outputs of the respective high-voltage circuit boards in the present example embodiment is described with reference to FIGS. 6 and 7. The image forming apparatus 1 performs the ATVC control during the non-image forming time, and calculates the target voltage value of the primary transfer bias to be applied to the primary transfer roller during the image forming time, as with the comparative configuration.

In the following description, the surface position of the photosensitive drum 51 that passes through the charging position P1 at a timing when the output of the charging DC is started, is defined as a charging rising start point Q1. The surface position of the photosensitive drum 51 that passes through the charging position P1 at a timing when the charging DC reaches the target voltage value, is defined as a charging rising completion point Q2. The surface position of the photosensitive drum 51 that passes through the transfer position P4 at a timing when the output of the primary transfer bias is started, is defined as a transfer rising start point q1. Further, the surface position of the photosensitive drum 51 that passes through the transfer position 41 at a timing when the output of the primary transfer bias reaches the voltage value corresponding to the target current value, is defined as the transfer rising completion point q2.

The charging rising start point Q1 corresponds to a first surface position of the image bearing member, and the charging rising completion point Q2 corresponds to a second surface position of the image bearing member. The surface positions (Q1, Q2, q1, and q2) in the present example embodiment have, for example, positional relationship illustrated in FIG. 2, and the charging rising completion point Q2 and the transfer rising completion point q2 are substantially the same as each other. FIG. 2 illustrates a state after the charging rising start point Q1 passes through the transfer position P4 and before the output of the primary transfer bias is started (before the transfer rising start point q1 reaches transfer position P4).

Figure 6:
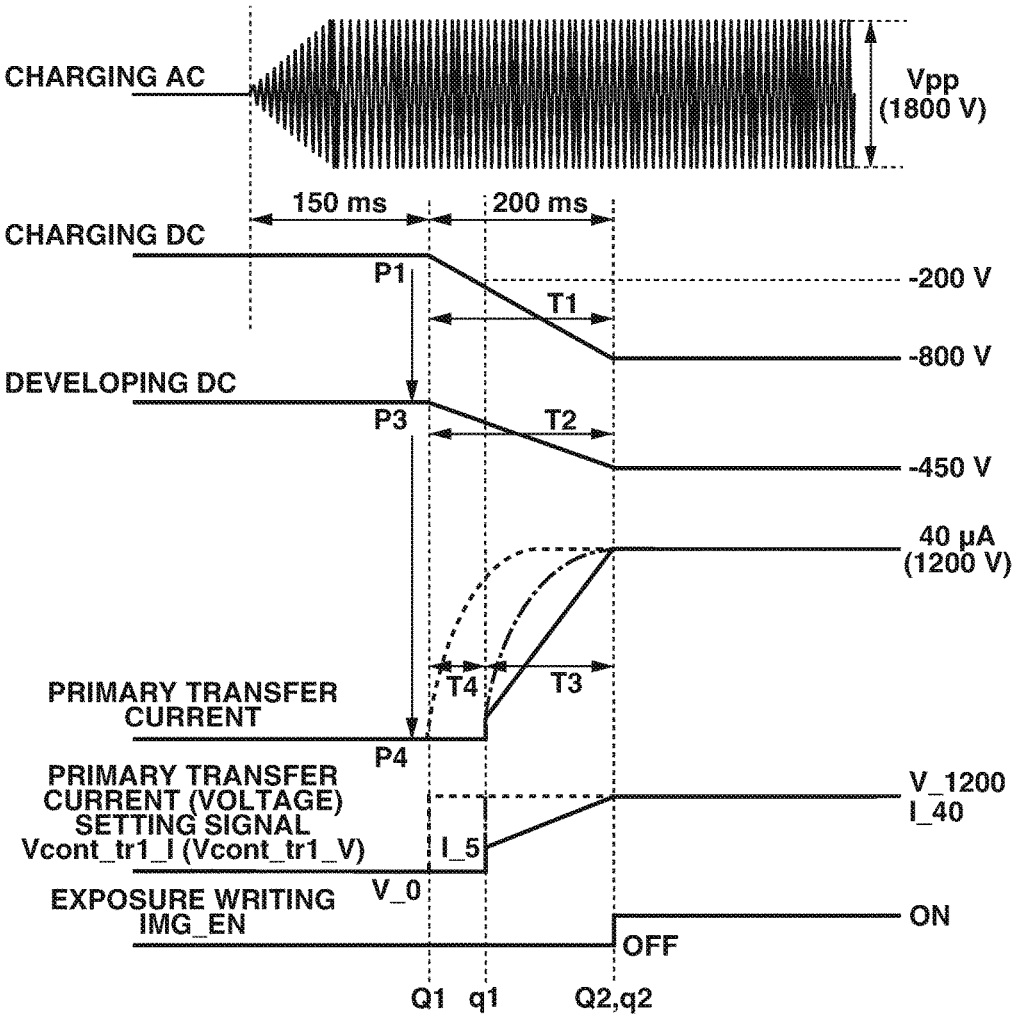
FIG. 6 is a timing chart illustrating outputs of the respective high-voltage circuit boards in the image forming apparatus according to the first example embodiment, with surface positions of a photosensitive drum as reference.

FIG. 6 illustrates the timing chart of the high-voltage raising control with the surface positions of the photosensitive drum as reference, as with the timing chart illustrated in FIG. 10. In other words, the horizontal axis in FIG. 6 indicates the time, and output waveforms of the respective high voltages are illustrated at positions shifted from an actual time axis in such a manner that the output values applied to the same position on the circumference of the surface of the photosensitive drum are illustrated at the same coordinate in the horizontal axis.

As illustrated in FIG. 6, in the high-voltage raising control according to the present example embodiment, the output of the charging DC is started after 150 ms from the output start of the charging AC. At this time, the charging DC is controlled so as to rise straightly, i.e., linearly with time, from 0 V as an initial potential to −800 V as the target voltage value taking a time period of 200 ms with a straight line (slope) inclined to the horizontal axis on the graph. Further, the output of the developing DC is started at a timing when the charging rising start point Q1 reaches the developing position P3, and the developing DC is controlled so as to rise linearly from 0 V as an initial potential to −450 V as the target voltage value taking a time period of 200 ms similar to the charging DC.

Further, the output of the primary transfer bias is started after the charging rising start point Q1 passes through the transfer position P4 and before the charging rising completion point Q2 reaches the transfer position P4. More specifically, the output of the primary transfer bias is started after 50 ms since the charging rising start point Q1 reaches the transfer position P4. Moreover, the primary transfer bias is controlled in such a manner that flowing of the constant primary transfer current (5 μm) is started at the same time when the output of the primary transfer bias is started, and the primary transfer current linearly rises to 40 μA as the target current value taking 1.50 ms (refer to solid line).

In the following description, the time that is previously set as a necessary time from the output start of each of the high voltages until the voltage value or the current value reaches the target voltage value or the target current value, is referred to as a total rising time, In the present example embodiment, a total rising time T1 of the charging DC and a total rising time T2 of the developing DC are both 200 ms, and a total rising time T3 of the primary transfer bias is 150 ms. The total rising time T1 of the charging DC corresponds to a first set time, and the total rising time T3 of the primary transfer bias corresponds to a second set time.

In the above-described comparative configuration, the constant voltage control under the predetermined target voltage value is performed on the primary transfer bias in the high-voltage raising control. In other words, as illustrated by a broken line or an alternate long and short dash line in FIG. 6, the signal level of the primary transfer voltage setting signal Vcont_tr1_V is discretely (instantaneously) switched to the target voltage value (−800 V) in one step at a timing of the output start. The fact that it is difficult for such a configuration to make the first copy output time (FCOT) smaller than a predetermined lower limit is described.

Further, in the comparative configuration, the raising of the primary transfer bias is started after the raising of the charging DC is completed. In other words, the output of the primary transfer bias Vtr1 is started at a timing after 200 ms since the charging rising start point Q1 reaches the transfer position P4 as illustrated in FIG. 10. This is because it is necessary to consider change the rising waveforms b1, b2, and b3 of the primary transfer current due to variation of the impedance of the primary transfer roller.

If the rising start timing of the primary transfer bias is moved forward to a timing before the elapse of 200 ms after the charging rising start point Q1 passes through the transfer position P4 (refer to broken line and alternate long and short dash line in FIG. 6), a transfer memory phenomenon (hereinafter, transfer memory) may occur. The transfer memory indicates a phenomenon in which the surface potential of the photosensitive member is varied due to electric charges supplied as the transfer current to the photosensitive member at the transfer portion, and unevenness of charging potential that leads to image defect such as density level difference and horizontal stripes occurs in a subsequent charging process. More specifically, in the present example embodiment, the transfer memory occurs in a case where the surface potential of the photosensitive drum becomes excessively high (changed to positive) by the transfer current because the toner including negative charging characteristic is used and the primary transfer bias is the positive voltage. In this case, even if the region where the transfer memory occurs reaches the charging position P1 and is charged by the charging roller, the region passes through the charging nip in a state where the surface potential of the region is higher than the surface potential of the surrounding region, and horizontal stripes or the like occur in the toner image that is formed through the processes of exposure, development, and transfer. Accordingly, in the comparative configuration, to avoid occurrence of the transfer memory, the output of the primary transfer bias is started at a timing after the elapse of 200 ms that is the estimated time necessary for rising completion of the charging DC after the charging rising start point Q1 reaches the transfer position P4.

Further, the trigger signal IMG_EN instructing the electrostatic latent image writing to the exposure device is output after the raising of the primary transfer bias is completed. In other words, the trigger signal IMG_EN is turned ON at a timing after the elapse of 120 ms as the estimated time necessary for rising completion of the primary transfer bias after the transfer rising start point q1 passes through the exposure position P2. This is because, if the output of the trigger signal IMG_EN is started at a timing earlier than that timing, the toner image is transferred while the primary transfer bias does not reach the target value, which may cause transfer defect. The time of 120 ms is the estimated time necessary for raising of the primary transfer bias, set in consideration of variation of the impedance of the primary transfer roller as described above.

Accordingly, in the comparative configuration, it is possible to start writing of the electrostatic latent image after the elapse of at least a time that is obtained by adding the estimated time necessary for the raising of the charging DC and the estimated time necessary for the raising of the primary transfer bias (200+120=320 [ms]), after the charging rising start point Q1 reaches the exposure position P2. It is difficult to reduce the FCOT by turning on the trigger signal IMG_EN at a timing earlier than that timing, in terms of prevention of the transfer memory and the transfer defect.

In FIG. 10, the change of the rising waveforms of the primary transfer bias Vtr1 and the primary transfer current Itr1 caused by changing of the impedance of the primary transfer roller are illustrated. However, the rising waveform of the charging DC may be changed due to changing of the impedance of the charging roller. In other words, in the case where the transfer current excessively large relative to the surface potential of the photosensitive drum formed by the charging bias flows, the transfer memory may occur other than the case where the impedance of the primary transfer roller is changed.

On the other hand, the control unit 11 of the present example embodiment controls the primary transfer bias through the constant current control in the high-voltage raising control. More specifically, the control unit 11 changes the signal level of the primary transfer current setting signal (Vcont_tr1_I) that specifies the output of the primary transfer current, to the set level I_5 of 5 μA, thereby starting the output of the primary transfer bias. Thereafter, the control unit 11 continuously changes the signal level of the primary transfer current setting signal (Vcont_tr1_I) to the set level I_40 of 40 μA. At this time, the signal level of the primary transfer current setting signal is controlled so as to linearly increase taking a time period of 150 ms that is the total rising time T3. As a result, the primary transfer bias and the primary transfer current output by the primary transfer high-voltage circuit board 90 are linearly changed taking a time period of 150 ms along with changing of the signal level of the primary transfer current setting signal.

Actually, the total rising time T3 of the primary transfer bias is finely divided into time widths to each of which the primary transfer high-voltage circuit board is adaptable, and the primary transfer current setting signal is switched in a stepwise manner to continuously change the signal level in a pseudo manner. In the present example embodiment, the primary transfer bias is raised while current-increase/time-increase per one step is set to 0.35 μA/1.5 ms and the number of steps is set to 100. The number of steps and the current-increase/time-increase per one step are changeable according to conditions, and values other than the values used in the present example embodiment are also available.

The total rising time T3 of the primary transfer bias is set longer than the estimated time necessary for the raising of the primary transfer bias if the set level of the primary transfer voltage setting signal is discretely switched in a manner similar to the comparative configuration. However, the estimated time is determined as the largest time necessary from the output start of the primary transfer bias until the output becomes stable at the target voltage value or the target current value, in consideration of variation of the impedance of the primary transfer roller 47 and the like. Since the estimated time necessary for the raising of the primary transfer bias in the comparative configuration is 120 ms, the total rising time T3 in the present example embodiment is set to 150 ms that is longer than the estimated time in the comparative configuration. Accordingly, when the primary transfer current setting signal is changed taking the total rising time T3 from the output start of the primary transfer bias, the value of the primary transfer current reaches the target value at substantially the same time when the total rising time T3 ends.

The control unit 11 determines that the writing of the electrostatic latent image by the exposure device can be started on condition that the raising of the charging DC and the raising of the primary transfer bias have been completed by the high-voltage raising control. Thus, the trigger signal IMG_EN instructing the electrostatic latent image writing is set to be turned an after both of the charging rising completion point Q2 and the transfer rising completion point q2 f the photosensitive drum pass through the exposure position P2. In the present example embodiment, the sum of the time T4 after the charging rising start point Q1 reaches the transfer position P4 until the output of the primary transfer bias is started and the total rising time T3 of the primary transfer bias is equal to the total rising time T1 of the charging DC. Accordingly, the transfer rising completion point q2 coincides with the charging rising completion point Q2. In other words, the control unit 11 outputs the trigger signal IMG_EN to the exposure device after 200 ms since the charging rising start point Q1 passes (after 150 ms since transfer rising start point q1 passes) through the exposure position P2.

Figure 7A:
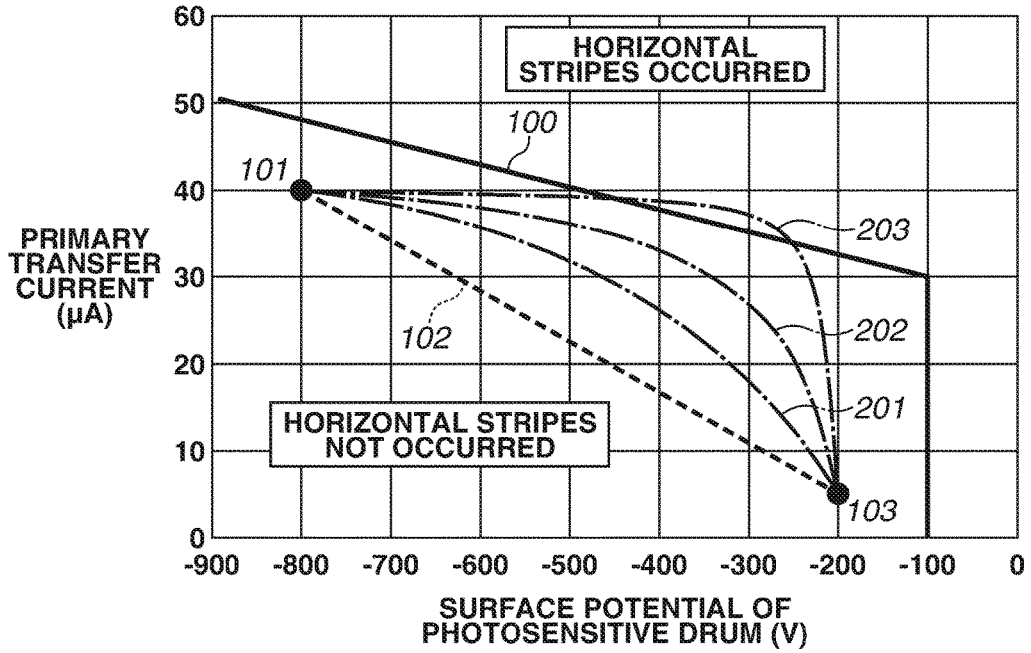
FIGS. 7A is a graph illustrating a threshold of a primary transfer current at which horizontal stripes occur and transition of the primary transfer current in high-voltage raising control according to the first example embodiment.
Figure 7B:
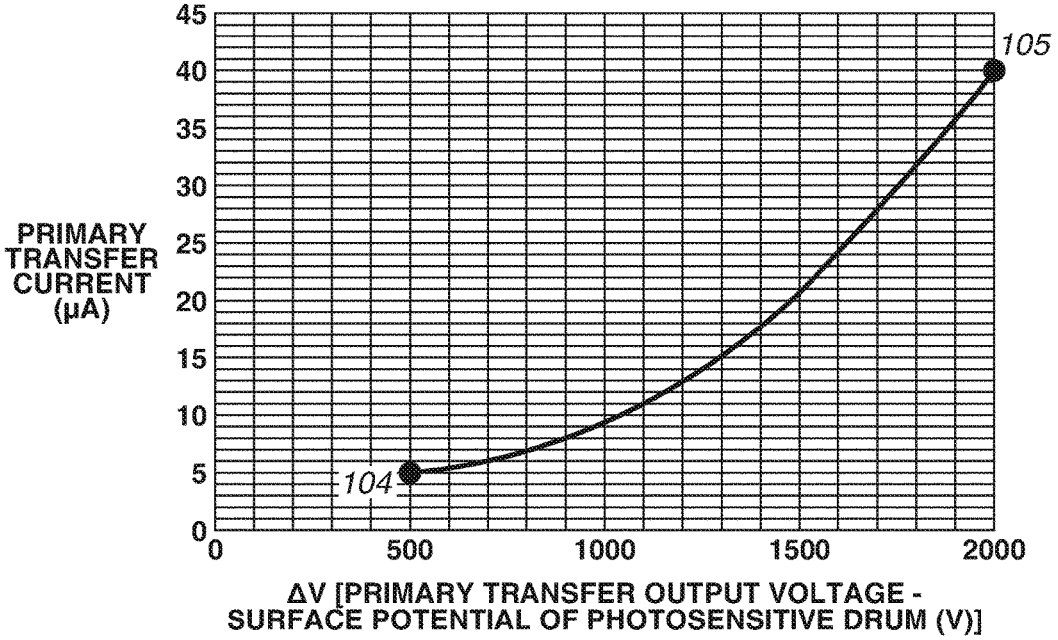
FIG. 7B is a graph illustrating a magnitude of the primary transfer current with respect to a difference between an output of a primary transfer bias and a surface potential a photosensitive drum.

Next, the reason why the transfer memory is reduced by such high-voltage raising control and the setting range of the transfer current to avoid the transfer memory are described with reference to FIGS. 7A and 7B. FIG. 7A is a graph illustrating a threshold of the primary transfer current at which horizontal stripes may occur and transition of the primary transfer current in the high-voltage raising control in the present example embodiment. FIG. 7B is a graph illustrating a relationship of a difference between the output of the primary transfer bias and the surface potential of the photosensitive drum, and the magnitude of the primary transfer current.

A region below a solid line 100 in FIG. 7A indicates a region where image defect such as horizontal stripes does not occur, i.e., a range where the transfer memory does not occur, and a region above the solid line 100 indicates a range where the transfer memory may occur. The horizontal stripes are defined as, for example, density unevenness in which the density difference to appropriate density is larger than 0.2 in a case where an image having a uniform density is to be formed on one sheet. The solid line 100 in FIG. 7A is determined with use of a result of the image density measured by a reflection densitometer (manufactured by X-Rite, Inc., reflection densitometer model 504).

The photosensitive drum 51 in the present example embodiment includes characteristics without dark decaying. In other words, in a case where a certain region of the photosensitive drum is charged at the charging position P1 and the region then reaches the transfer position P4 without exposure, the surface potential immediately after passing through the charging position P1 and the surface potential immediately before entering the transfer position P4 are substantially equal to each other. Accordingly, in the following description, the surface potential immediately after passing through the charging position P1 is identified with the surface potential immediately before entering the transfer position P4 as "surface potential of photosensitive drum". However, even in a configuration using the photosensitive drum on which the dark decaying occurs the relative magnitude difference of the surface potential is normally retained even if the dark decaying occurs. Therefore, the high-voltage raising control of the present example embodiment is applicable to such a configuration.

In the present example embodiment, the primary transfer bias in the image forming time is set to a voltage (1200 V in the example of FIG. 6) at which the primary transfer current becomes 40 μA when the surface potential of the photosensitive drum 51 is −800 V. A point 101 in FIG. 7A indicates the surface potential of the photosensitive drum 51 and the primary transfer current at the image forming time and is set within the range where the transfer memory does not occur, i.e., within the range below the solid line 100. Further, a point 103 indicates a surface potential at a time point when the output of the primary transfer bias is started, i.e., immediately before the transfer rising start point q1 passes through the transfer position P4, and the primary transfer current (5 μA) at a time point when the output of the primary transfer bias is started.

The primary transfer current is a discharge current that is caused by the difference (potential difference ΔV) between the surface potential of the photosensitive drum and the potential of the primary transfer roller, and relationship between the potential difference ΔV and the primary transfer current is defined by Paschen's law. A curve in FIG. 7B indicates the relationship between the potential difference ΔV and the primary transfer current that is calculated based on the configuration in the present example embodiment and Paschen's law. For example, the point 103 in FIG. 7A and a point 104 in FIG. 7B correspond to the transfer rising start point, the potential difference ΔV is 500 V, and the primary transfer current is 5 μA. The surface potential of the photosensitive drum 51 at this time is −200 V, and the primary transfer bias is 300 V. The point 101 in FIG. 7A and a point 105 in FIG. 7B correspond to the transfer rising completion point, the potential difference ΔV is 2000 V, and the primary transfer current is 40 μA. The surface potential of the photosensitive drum 51 at this time is −800 V, and the primary transfer bias is 1200 V. Accordingly, the output voltage of the primary transfer bias during the period from the output start of the primary transfer bias until the output reaches the target voltage value (1200 V, refer to FIG. 6) is determined based on the set level of the primary transfer current setting signal and the correspondence relationship illustrated in FIG. 7B.

In the high-voltage raising control of the present example embodiment, the relationship between the surface potential at the surface position of the photosensitive drum gradually entering the transfer position P4 and the primary transfer current flowing when the surface position passes through the transfer position P4 makes a transition to follow a broken line 102 illustrated in FIG. 7A. More specifically, the surface potential and the primary transfer current value are maintained in the region below the solid line 100 during a period after the charging rising start point passes through the transfer position P4 until the transfer rising completion point passes through the transfer position P4. This prevents the primary transfer current excessively large relative to the surface potential from flowing during the high-voltage raising control, and to prevent the transfer memory.

On the other hand, in a case where the primary transfer voltage setting signal is discretely changed in one step as illustrated by the alternate long and short dash line in FIG. 6, the primary transfer current is rapidly increased as illustrated by alternate long and short dash lines 201, 202, and 203 in FIG. 7A. The alternate long and short dash line 201 indicates a case where the impedance of the primary transfer roller is relatively large, the alternate long and short dash line 203 indicates a case where the impedance is relatively small, and the alternate long and short dash line 202 indicates a case where the impedance is medium. The primary transfer current rises drastically and possibility that the primary transfer current exceeds the solid line 100 as illustrated by the alternate long and short dash line 203 during the raising to cause the transfer memory is enhanced, as the impedance of the primary transfer roller is smaller.

<Effects of Present Example Embodiment>

As described above, in the present example embodiment, the output of the primary transfer bias is started after the charging rising start point Q1 (first surface position) passes through the transfer position P4 and before the charging rising completion point Q2 (second surface position) reaches the transfer position P4. In other words, the surface region of the photosensitive drum where the raising of the primary transfer bias is performed is overlapped with the surface region where the raising of the charging DC is performed. Further, the rising waveforms are controlled in such a manner that the charging DC is linearly increased during 200 ms as the first set time and the primary transfer bias is linearly increased during 150 ms as the second set time.

Accordingly, as compared with the case where the target output of each of the charging DC and the primary transfer bias is discretely switched in one step as with the comparative configuration it is possible to prevent the primary transfer current excessively large relative to the surface potential of the photosensitive drum from flowing, and to suppress occurrence of the transfer memory. Further, as compared with the case where the raising of the charging DC and the raising of the primary transfer bias are sequentially performed as with the comparative configuration, the surface region where the raising of the charging DC and the raising of the primary transfer bias have been completed reaches the exposure position earlier. Therefore, the high-voltage raising control of the present example embodiment makes it possible to reduce the FCOT while avoiding occurrence of the transfer memory through control of the rising waveforms of the charging DC and the primary transfer current.

In particular, in the present example embodiment, the control is performed so that the rising completion of the charging DC and the rising completion of the primary transfer bias are synchronized with each other. More specifically, as illustrated in FIG. 2 and FIG. 6, the rising completion timing of both of the charging DC and the primary transfer bias are controlled so that the charging rising completion point Q2 and the transfer rising completion point q2 are located at the same surface position on the surface of the photosensitive drum 51. As a result, as compared with the configuration in which the raising of the primary transfer bias is completed after the charging rising completion point Q2 passes through the transfer position P4, it is possible to reduce unevenness of the charging potential, and to effectively suppress occurrence of density level difference and horizontal strips in the output image. In addition, it is possible to minimize the time from the start of the high-voltage raising control until the trigger signal IMG_EN instructing the electrostatic latent image writing is turned on, and to reduce the FCOT as much as possible on the assumption of avoidance of the transfer memory.

The rising completion of the charging DC and the rising completion of the primary transfer bias may not be synchronized with each other. In other words, the sum of the total rising time T3 of the primary transfer bias and the waiting time T4 after the charging rising start point Q1 reaches the transfer position P4 until the output of the primary transfer bias is started may be set longer or shorter than the total rising time T1 of the charging DC and the total rising time T2 of the developing DC. However, the time difference between the timing when the charging rising completion point Q2 passes through the transfer position P4 and the timing when the raising of the primary transfer bias is completed is preferably 20% or lower of the time necessary for the raising of the charging DC (first set time). This makes it possible to reduce unevenness of the charging potential and to efficiently reduce the FCOT. In addition, bringing the above-described time difference close to zero, for example, 10% or lower of the first set time makes it possible to further reduce unevenness of the charging potential.

Furthermore, the output of the primary transfer bias is preferably started before a half of the first set time elapses after the charging rising start point Q1 passes through the transfer position P4, and the second set time is preferably equal to or larger than the half of the first set time and equal to or smaller than the first set time. In other words, setting is preferably performed in such a manner that the output of the primary transfer bias is started while the surface potential of the photosensitive drum at the transfer position P4 is equal to or lower 50% of the target voltage value of the charging DC. Such setting makes it possible to reduce the FCOT while relatively moderating the raising of the primary transfer current and controlling the rising waveform with high accuracy.

Further, in the present example embodiment, the output of the primary transfer high-voltage circuit board is controlled in such a manner that the value of the primary transfer current is maintained to be lower than the predetermined threshold illustrated by the solid line 100 in FIG. 7A, during the period from the output start of the primary transfer bias until the second set time elapses. This makes it possible to prevent the primary transfer current excessively large relative to the surface potential at the surface position reaching the transfer position P4 from flowing, and to more surely avoid occurrence of the transfer memory.

In the present example embodiment, the threshold of the primary transfer current is set to the minimum value of the transfer current that reverses the surface potential of the photosensitive drum from the first polarity (negative polarity) that is the same as the polarity of the charging DC, to the opposite second polarity (positive polarity). Easiness of occurrence of the transfer memory, however, depends on the configuration of the image forming unit. Accordingly, the above-described predetermined threshold is preferably appropriately changed according to the configuration of the image forming unit so as not to cause the transfer memory as image defect such as horizontal stripes.

Further, in the present example embodiment, the high-voltage raising control in which the direct-current component of the developing bias (developing DC) and the charging DC are raised in synchronization with each other is performed in the configuration in which the development is performed with use of the two-component developer. In other words, as illustrated in FIG. 6, the developing DC is controlled so as to linearly change to the target voltage value (−450 V) taking a time of 150 ms as the first set time after the timing when the charging rising start point Q1 reaches the developing position P3. As a result, the potential of the developing sleeve 55 (see FIG. 2) with respect to the photosensitive drum 51 is maintained within a range where the toner or the carrier are prevented from being attached to the photosensitive drum, during the period in which the region from the charging rising start point Q1 to the charting rising completion point Q2 of the photosensitive drum passes through the developing position P3.

The case where the above-described high-voltage raising control is applied to the tandem type image forming apparatus 1 has been described in the present example embodiment. However, the above-described high voltage raising control may be applied to an image forming apparatus of other systems such as a monochrome system or a monocolor system. Further, the image forming apparatus is not limited to the printer, and may be implemented for various applications such as various kinds of printing apparatuses, copying machines, facsimile machines, and multifunction peripherals. Furthermore, the image forming apparatus 1 of the present example embodiment is of the intermediate transfer system in which the toner image formed on the photosensitive drum is transferred to the recording medium through the intermediate transfer belt serving as the intermediate transfer member. Alternatively, the present example embodiment may be applied to a direct transfer system in which the toner image formed on the photosensitive drum is directly transferred to the recording medium. In this case, the transfer bias voltage applied to the transfer member, such as a transfer roller, that transfers the toner image formed on the surface of the photosensitive drum to the recording medium may be controlled by a method similar to the above-described method of controlling the primary transfer bias.

Next, high-voltage raising control an image forming apparatus according to a second example embodiment is described with reference to FIGS. 8 and 9. The present example embodiment is different from the above-described first example embodiment in that the primary transfer bias is raised in a stepwise manner, and other configurations of the present example embodiment are similar to the configurations of the first example embodiment. In the following description, the components common to the components in the first example embodiment are denoted by the same reference numerals, and description of such components is omitted.

Figure 8:
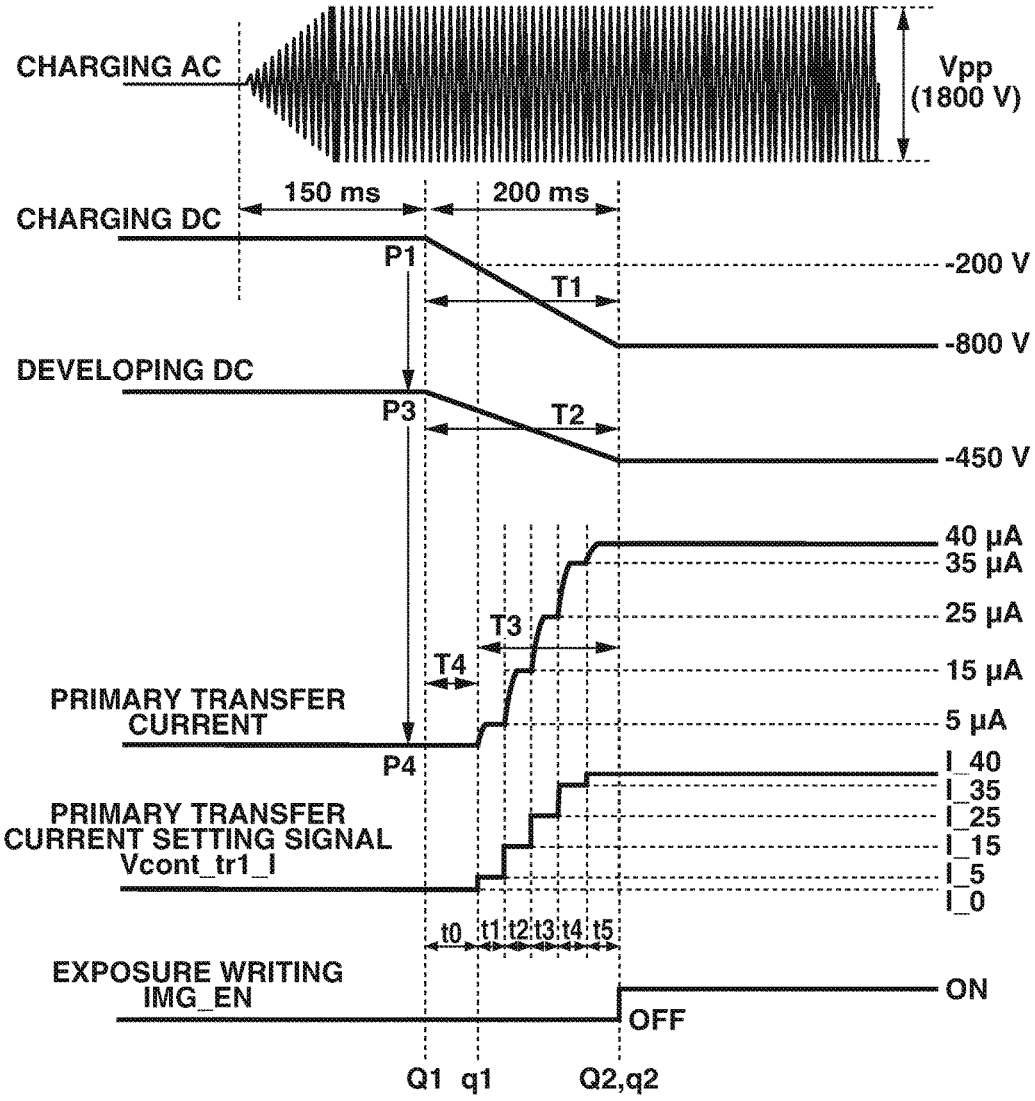
FIG. 8 is a timing chart illustrating outputs of respective high-voltage circuit boards in an image forming apparatus according to a second example embodiment, with surface positions of a photosensitive drum as reference.

FIG. 8 is a timing chart of the high-voltage raising control with the surface positions of the photosensitive drum as reference, as with the timing charts illustrated in FIG. 6 and FIG. 10. As illustrated in FIG. 8, the charging DC and the developing DC are controlled so as to be linearly raised to the respective target voltages (−800 V and −450 V) taking the total rising times T1 and T2 (200 ms) that are the same as those in the first example embodiment. The output of the primary transfer bias is started at a timing when a predetermined waiting time T4 (40 ms) has elapsed after the charging rising start point Q1 reaches the transfer position P4.

In the present example embodiment, the primary transfer bias is controlled so as to be raised to the output corresponding to the target current value (40 μA) taking 150 ms as the total rising time T3 in a stepwise manner of five steps. More specifically, the control unit 11 sequentially switches the primary transfer current setting signal (Vcont_tr1_I) from the set level (I_0) of 0 μA to set levels (I_5, I_15, I_25, I_35, and I_40) of 5 μA, 15 μA, 25 μA, 35 μA, and 40 μA. The switching of the primary transfer current setting signal is performed while the rising times t1, t2, t3, t4, and t5 of the respective steps are each set to 30 ms. An interval of the switching between the steps is set to be longer than the estimated time until the primary transfer current reaches the current value of the set level, in consideration of variation of the impedance of the primary transfer roller, and the like. The control unit 11 outputs the trigger signal IMG_EN instructing start of the electrostatic latent image writing after 30 ms since the primary transfer current setting signal is switched from the set level I_35 of 35 μA to the set level I_40 of 40 μA.

Figure 9:
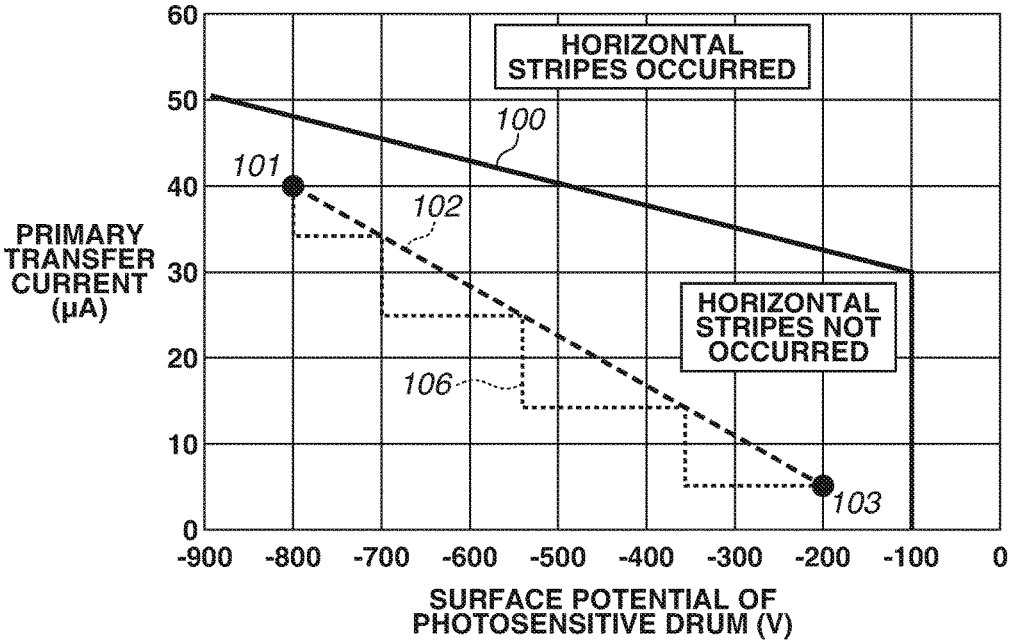
FIG. 9 is a graph illustrating a threshold of the primary transfer current at which horizontal stripes occur and transition of the primary transfer current in high-voltage raising control according to the second example embodiment.

In the case where the charging DC and the primary transfer bias are raised through such high-voltage raising control, the surface potential of the photosensitive drum and the primary transfer current at the transfer position P4 make a transition along a dotted line 106 in FIG. 9. The solid line 100 indicating the threshold at which horizontal stripes occur, and contents represented by the points 101 and 103 and the broken line 102 are the same as those illustrated in FIG. 6. As illustrated in FIG. 9, the primary transfer bias is raised in a stepwise manner of five steps in the present example embodiment. Thus, the dotted line 106 becomes a stepwise curve with five steps. Further, any of the points on the dotted line 106 are located in the region below the solid line 100, and thus occurrence of image defect such as horizontal stripes due to the transfer memory is prevented.

Also in the high-voltage raising control of the present example embodiment, the output of the primary transfer bias is started after the charging rising start point Q1 passes through the transfer position P4 and before the charging rising completion point Q2 reaches the transfer position P4, as with the above-described first example embodiment. Further, the rising waveforms are controlled in such a manner that the charging DC is linearly increased taking 200 ms as the first set time and the primary transfer bias is increased in a stepwise manner taking 150 ms as the second set time.

Accordingly, as compared with the case where the target output of each of the charging DC and the primary transfer bias is discretely switched in one step as with the above-described comparative configuration, it is possible to suppress occurrence of the transfer memory. In addition, compared with the case where the raising of the charging DC and the raising of the primary transfer bias are sequentially performed as with the comparative configuration, the surface region where the raising of the charging DC and the raising of the primary transfer bias have been completed reaches the exposure position earlier. In other words, according to the high-voltage raising control of the present example embodiment, it is possible to reduce the FCOT while avoiding occurrence of the transfer memory through control of the rising waveforms of the charging DC and the primary transfer current. In particular, in the present example embodiment, since the set level of the primary transfer current is switched in a stepwise manner, it is possible to easily perform the control as compared with the above-described first example embodiment in which the primary transfer current is linearly increased. More specifically, the number of times of calculating the voltage value to be output by the primary transfer bias from the correspondence relationship as illustrated in FIG. 7B is smaller than that of the first example embodiment. Therefore, a processing load of the control unit can be reduced.

Further, the control is performed in such a manner that the rising completion of the charging DC and the rising completion of the primary transfer bias are synchronized with each other, as with the first example embodiment. This makes it possible to reduce unevenness of the charging potential and to effectively suppress occurrence of density level difference and horizontal stripes in the output image. Moreover, the output of the primary transfer high-voltage circuit board is controlled to maintain the state where the value the primary transfer current is smaller than the predetermined threshold (i.e., solid line 100 in FIG. 8), during the period after the output of the primary transfer bias is started until the second set time elapses. This makes it possible to more surely avoid occurrence of the transfer memory.

The number of steps in the raising of the primary transfer bias may be larger than or smaller than five steps. Further, the rising times t1 to t5 of the respective steps may be set to a length other than 30 ms, and the lengths of the rising times may be different among the steps. In any case, it is possible to prevent occurrence of horizontal stripes and the like caused by the transfer memory as long as the rising waveform of the primary transfer current is controlled so as to reach the point 101 through the region below the solid line 100 in FIG. 9. Further, the primary transfer current is set to be raised linearly or in a stepwise manner in the above-described first and second example embodiments. However, the charging DC may be set to be raised taking a predetermined time (first set time) a stepwise manner. Also in this case, the high-voltage raising control is performed to maintain the surface potential of the photosensitive drum and the primary transfer current at the transfer position P4, to appropriate relationship corresponding to the region below the solid line 100 illustrated in FIG. 7B, which makes it possible to reduce the FCOT while preventing occurrence the transfer memory.

In addition, the waveform of the charging DC is raised in a slope shape in the first and second example embodiments. However, the charging DC may be raised to the target charging voltage in one step.

Further, in the present example embodiment, the primary transfer current is set to be raised linearly or in a stepwise manner in the raising of the transfer bias. However, the setting is not limited thereto. For example, in the raising of the transfer bias, the transfer voltage may be controlled to be raised linearly or in a stepwise manner based on a voltage detection circuit that detects the transfer voltage.

Further, in the present example embodiment, the raising of the transfer bias is performed after the position at which application of the charging bias is started passes through the transfer position P4. However, the raising timing is not limited thereto. For example, the transfer bias may be applied before the position at which the application of the charging bias is started passes through the transfer portion within the range where the transfer current does not flow to the transfer position P4.

The image forming apparatus according to the example embodiments makes it possible to prevent image defect such as horizontal stripes caused by charging unevenness and to reduce the FCOT.

While the subject disclosure has been described with reference to numerous example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-056112, filed Mar. 22, 2017, which is hereby incorporated by reference herein in its entirety.

What is claimed is:

1. An image forming apparatus, comprising:

a photosensitive member that rotates;

a charging member configured to charge the photosensitive member at a charging portion;

a charging bias output portion that outputs a charging bias to the charging member;

a transfer member configured to transfer a toner image borne on the photosensitive member to a transfer medium at a transfer portion;

a transfer bias output portion that outputs transfer bias to the transfer member, the transfer bias having a polarity opposite to that of the charging bias;

a current detection circuit that detects a transfer current flowing through the transfer member; and a control portion that controls the charging bias output portion and said transfer bias output portion, wherein said control portion controls said charging bias output portion such that the charging bias is a predetermined bias voltage, which is lower than an absolute value of a target charging bias to be set in image formation at a first predetermined timing in a first period from when the charging bias starts raising along with start of image formation until when the charging bias reaches the target charging bias, and wherein said control portion controls said transfer bias output portion such that the transfer bias starts raising along with start of image formation in a second period in which a region of the photosensitive member, that passed through the charging portion during the first period, is passing through the transfer portion, and the transfer current flowing through the transfer member is a predetermined current, which is lower than a target transfer current to be set in a transferring period in which the toner image on the photosensitive member is transferred to the transfer medium, at second predetermined timing in the second period based on a detection result of said current detection circuit.

2. The image forming apparatus according to claim 1, wherein said control portion controls said transfer bias output portion such that the absolute value of the transfer bias is raised in a stepwise manner in the second period.

3. The image forming apparatus according to claim 1, wherein said control portion controls said charging bias output portion and said transfer bias output portion so that a time difference between a timing when a trailing end of the region of said photosensitive member that passes through the charging portion during the first period reaches the transfer portion and a timing when the transfer current reaches the target transfer current, to be equal to or lower than 20% of the first period.

4. The image forming apparatus according to claim 1, wherein said control portion performs constant voltage control to cause the transfer bias output by the transfer bias output portion to be the target transfer bias during the transferring period.

5. The image forming apparatus according to claim 1, wherein said control portion controls said transfer bias output portion so as to prevent the region of said photosensitive member that has passed through the transfer portion from being charged with a same polarity as a polarity of the transfer bias by the transfer current flowing through the transfer portion during the second period.

6. The image forming apparatus according to claim 1, wherein, when the region of the photosensitive member that passes through the charging portion during the first period is set as a first region and a region of the photosensitive member passing through the transfer portion during a period from when the transfer bias starts raising along with start of image formation until when the transfer bias reaches the target transfer bias is set as a second region, the second region has a length shorter than a length of the first region in a movement direction of the photosensitive member.

7. The image forming apparatus according to claim 6, wherein said control portion controls said transfer bias output portion such that the transfer bias starts raising along with start of image formation before an intermediate point of the first region passes through the transfer portion in the movement direction of the image bearing member.

8. The image forming apparatus according to claim 6, further comprising:

a developer bearing member that forms a developing portion between the photosensitive member and the developer bearing member, and to rotate while bearing two-component developer containing magnetic carrier and non-magnetic toner; and a developing bias output portion that outputs, to the developer bearing member, a developing bias including a developing bias of a same polarity as a charging polarity of the non-magnetic toner, to develop an electrostatic latent image borne on the photosensitive member, at the developing portion, wherein the control portion performs control so as to increase a direct-current component of the developing bias linearly or in a stepwise manner to a target developing voltage value after a leading end of the first region reaches the developing portion.

9. The image forming apparatus according to claim 1, wherein the control portion controls the transfer bias output portion such that the transfer bias is linearly increased in the second period.

* * * * *